United States Patent [19]

Hale et al.

[11] Patent Number: 4,486,685

[45] Date of Patent: Dec. 4, 1984

[54] ELECTRON GUN ASSEMBLY WITH BEAD STRAP HAVING AN ANGULATED GRASPING MEMBER

[75] Inventors: John R. Hale, Lancaster; Robert J. Alexander, Quarryville, both of Pa.

[73] Assignee: RCA Corporation, New York, N.Y.

[21] Appl. No.: 378,240

[22] Filed: May 14, 1982

[51] Int. Cl.[3] ..... H01J 29/48

[52] U.S. Cl. ..... 313/417; 313/457

[58] Field of Search ..... 313/417, 457

[56] References Cited

U.S. PATENT DOCUMENTS

| | | | |
|---|---|---|---|
| 3,659,134 | 4/1972 | Wanner | 313/457 |
| 3,701,920 | 10/1972 | Wanner | 313/457 X |
| 3,772,554 | 11/1973 | Hughes | 313/412 |
| 3,873,879 | 3/1975 | Hughes | 315/13 C |
| 4,071,803 | 1/1978 | Takanashi et al. | 313/409 |
| 4,096,408 | 6/1978 | Bozzay et al. | 313/417 |
| 4,298,818 | 11/1981 | McCandless | 313/417 |

FOREIGN PATENT DOCUMENTS

| | | |
|---|---|---|
| 1596772 | 11/1970 | Fed. Rep. of Germany . |
| 822556 | 10/1959 | United Kingdom . |
| 1528128 | 10/1978 | United Kingdom . |
| 2005464A | 4/1979 | United Kingdom . |

*Primary Examiner*—Palmer Demeo
*Assistant Examiner*—Sandra L. O'Shea
*Attorney, Agent, or Firm*—Eugene M. Whitacre; Dennis H. Irlbeck; Vincent J. Coughlin, Jr.

[57] ABSTRACT

The present invention is an improvement in an electron gun assembly. Such a gun assembly includes a plurality of indirectly heated cathode assemblies and at least two spaced successive electrodes having aligned apertures therein for passage of a plurality of electron beams. The cathode assemblies include a plurality of cathode heaters which are attached to at least two electrically insulating support rods by a plurality of heater bead straps. Each of the heater bead straps includes a main body portion having a distal end and a proximal end. The proximal end has a bifurcated portion comprising a pair of closely spaced apart grasping members for embedment into one of the insulating support rods. At least one member of the pair of grasping members is angulated with respect to the main body portion to increase the retention of the heater bead straps to the insulating support rods.

5 Claims, 5 Drawing Figures

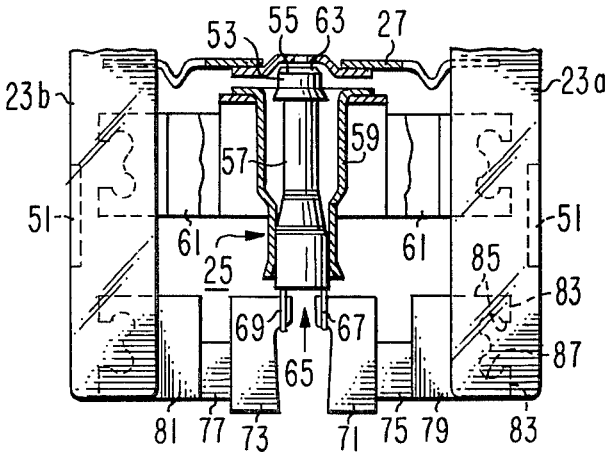
Fig. 2
PRIOR ART
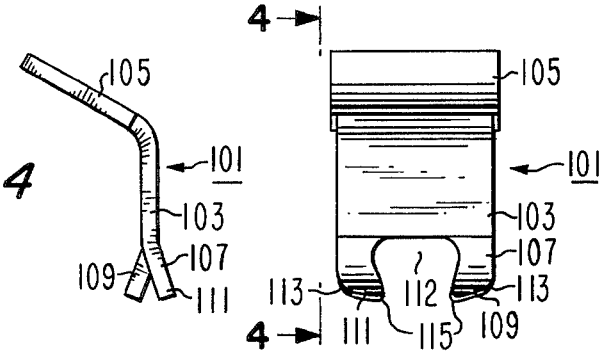
Fig. 4
Fig. 3
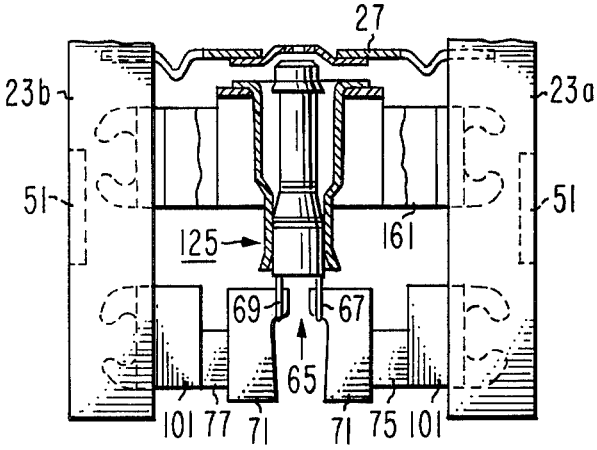
Fig. 5

ELECTRON GUN ASSEMBLY WITH BEAD STRAP HAVING AN ANGULATED GRASPING MEMBER

BACKGROUND OF THE INVENTION

This invention relates to an electron gun assembly and particularly to an electron gun assembly for use in a multi-beam cathode ray tube in which a plurality of bead straps having angulated grasping members are utilized to secure the bead straps to at least two support rods.

A cathode-ray tube, for example, a television picture tube, usually employs at least one electron gun with an indirectly-heated cathode assembly. Most color television picture tubes employ three such guns. That type of assembly includes a disc-shaped cathode substrate having an electron-emissive coating on the obverse surface thereof and a grid closely spaced from the coating. A coated-wire resistance heater is closely spaced from the other reverse surface of the substrate. The substrate may be supported on a tubular member, which may also contain the heater with two legs of the heater extending therefrom. All of the parts are attached to a pair of common insulating support rods.

Each leg of the heater is indirectly affixed to a common support rod via a heater bead strap. Unlike the grids of the electron gun which are secured between the pair of support rods, each heater bead strap is attached to only one of the support rods. In order to attach the heater bead strap to the support rod, a claw is formed in one end of the bead strap and the claw is embedded into the support rod at an elevated temperature. Frequently, the claw of the heater bead strap is loosely embedded into the support rod so that the heater is free to move during electron gun operation. Such movement, particularly in a multi-beam cathode ray tube having a plurality of cathodes, produces variations between cathodes and adversely affects the electrical characteristics of the electron gun. Additionally, the movement of the heater bead strap may generate particles from the support rod. Such particles are undesirable since they may cause spots on the screen of the tube.

SUMMARY OF THE INVENTION

The present invention is an improvement in an electron gun assembly. Such a gun assembly includes means for generating and directing at least one electron beam along a beam path. The aforerecited means is spaced along a plurality of insulating support means and attached thereto by attachment means. The improvement comprises a securing claw having a pair of closely spaced apart grasping members formed in the end of the attachment means. At least one member of the pair of grasping members is angulated with respect to the other grasping member to increase the retention of the attachment means to the insulating support means.

BRIEF DESCRIPTION OF THE DRAWINGS

FIG. 2 is a broken-away, front elevational view of a portion of the prior art electron gun assembly of FIG. 1 including an indirectly-heated cathode assembly.

FIG. 3 is a front plan view of a novel heater bead strap.

FIG. 4 is a side elevational view along section line 4—4 of FIG. 3.

FIG. 5 is a broken-away, front elevational view of a portion of an electron gun assembly including an indirectly-heated cathode assembly and the novel heater bead straps of the present invention.

DETAILED DESCRIPTION OF THE PREFERRED EMBODIMENT

Figure 1:
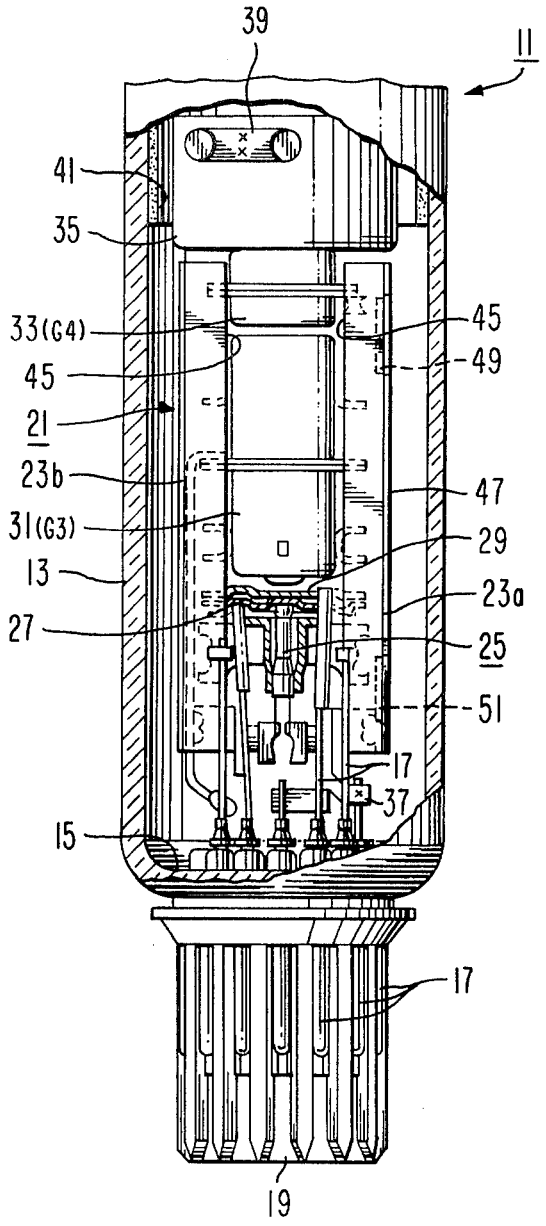
Fig. 1 PRIOR ART
FIG. 1 is a broken-away, front elevational view of a prior art electron gun assembly.

FIG. 1 shows structural details of a prior art electron gun assembly mounted in the neck of a cathode-ray tube (CRT). The structure of this electron gun assembly is similar to the electron gun assembly described in U.S. Pat. No. 3,873,879 issued to R. H. Hughes on Mar. 25, 1975 and incorporated herein for the purpose of disclosure. Except for differences in the claw structure of the heater and/or cathode assembly bead straps, the prior art electron gun assembly and the electron gun assembly in accordance with the present invention utilize the same structure; consequently, the detailed description of the structure depicted in FIG. 1 is applicable to both.

An improved electron gun includes an evacuated glass envelope 11, which in a complete CRT includes a rectangular faceplate panel and a funnel having a neck 13 integrally attached thereto. A glass stem 15 having a plurality of leads or pins 17 extending therethrough is sealed to and closes the end of the neck 13. A base 19 is attached to the pins 17 outside the envelope 11.

An in-line beaded bipotential electron gun assembly 21, centrally mounted within the neck 13, is designed to generate and project three electron beams along coplanar convergent paths having a common, generally longitudinal direction toward the viewing screen. The gun assembly comprises two electrically insulating glass support rods or beads 23*a* and 23*b* from which the various electrodes are supported to form a coherent unit in a manner commonly used in the art. These electrodes include three substantially equally transversely-spaced coplanar cathode assemblies 25 (one for producing each beam), a control-grid electrode 27 (also referred to as G1), a screen-grid electrode 29 (also referred to as G2), a first accelerating and focusing electrode 31 (also referred to as G3), a second accelerating and focusing electrode 33 (also referred to as G4), and a shield cup 35, longitudinally-spaced in that order along the rods 23*a* and 23*b*. The various electrodes of the gun assembly 21 are electrically connected to the pins 17 either directly or through metal ribbons 37. The gun assembly 21 is held in a predetermined position in the neck 13 on the pins 17 and with snubbers 39, on the shield cup 35, which press on and make contact with an electrically conducting internal coating 41 on the inside surface of the neck 13. The internal coating 41 extends over the inside surface of the funnel and connects to the anode button (not shown).

Each of the support rods 23*a* and 23*b* is a parallelepiped member about 11 mm (millimeters) wide by about 48 mm long by about 4.25 mm thick. The rods 23*a* and 23*b* are formed by compacting or pressing a suitable glass powder in a mold. The rods are fired or glazed after molding to outgas the material, to fix the dimensions of the rods and to strengthen the rods and make them less likely to chip or crack. The support rods and 23*a* and 23*b* have a mounting surface 45 and a beading support surface 47. A chamfer of about 30° is molded into both longitudinally-extending edges of the rods adjacent to the beading support surface 47 to facilitate the subsequent beading operation. The various electrodes 25–33 each include support tabs which are embedded into the mounting surfaces 45 of the support rods 23*a* and 23*b*. At least two indexing cavities 49 and 51 are formed into the beading support surface 47 of the support rods 23*a* and 23*b* during the molding operation. The indexing cavities 49 and 51 are located on the center line of the longitudinal bead axis and facilitate aligning the support rods during the beading operation. The beading operation is described in copending U.S. patent application Ser. No. 258,739, filed on Apr. 29, 1981, now U.S. Pat. No. 4,341,545 issued on July 27, 1982 to J. R. Hale, assigned to the same assignee as the present invention and incorporated by reference herein for the purpose of disclosure.

As shown in FIG. 2, the cathode assembly 25 comprises a cathode cup including a sidewall 53 and an integral endwall 55, which is the cathode substrate. The sidewall 53 is welded to one end of a cylindrical cathode sleeve 57, which is welded at its other end to a cathode eyelet 59. A cathode support 61 is welded to the cathode eyelet 59 and embedded on each side thereof in the glass support rods 23*a* and 23*b*. The outer or obverse side of the endwall 55 carries a layer 63 of electron emissive material. A double-spiraled coated wire resistance heater 65 is located in the sleeve 57. Two heater legs or ends 67 and 69 of the wire heater 65 extend beyond the sleeve 57 and are welded to attachment means including two tab legs 71 and 73, which are welded to two heater connectors 75 and 77, respectively. The heater connectors 75 and 77 are welded to two heater bead straps 79 and 81, respectively. The heater bead straps 79 and 83 are embedded in the glass support rods 23*a* and 23*b*, respectively.

The ends of the heater bead straps 79 and 81 which are embedded in the glass support rods 23*a* and 23*b* comprise claw-like members at the ends of the straps. In the prior art structure, shown in FIGS. 1 and 2, the claws have blunt ends 83 and square corners 85 with a claw cavity 87 designed to capture glass during the beading operation so as to retain the heater bead straps 79 and 81 within the support rods 23*a* and 23*b*, respectively. The claw design of FIG. 2 is quite successful in capturing glass; however, the square corners 85 of the claws cause high stress concentrations in the glass support rods 23*a* and 23*b* which result in mechanical and electrical failures. Additionally, the square corners 85 cause a great amount of viscous drag during insertion of the claws into the glass support rods 23*a* and 23*b* in the beading operation.

An improved heater bead strap 101 is shown in FIGS. 3 and 4. The improved heater bead strap 101 comprises a main body portion 103 having a distal end 105 and a proximal end 107. The proximal end 107 includes a bifurcated portion or claw comprising a pair of closely spaced apart grasping members 109 and 111 defining a cavity 112 therebetween. The cavity 112 typically comprises about 60 percent of the width of the proximal end 107 of the heater bead strap 101. The outer edge 113 of each of the grasping members 109 and 111 is formed to have a radius which is typically equal to about the width of one of the grasping members at the narrowest point thereof. Typically, the outer edge has a radius of about 0.51 mm and the inner edge 115 is formed to have a radius in the order of 0.13 mm to 0.25 mm. To further reduce the viscous drag of the grasping members 109 and 111, the inner leading edge 115 of each grasping member forms an angle of about 10 to 15 degrees with respect to the outer edge 113 of the grasping member. To further improve the retention of the improved heater bead strap 101 within the support rods, the grasping members 109 and 111 are angled with respect to the main body portion 103 of the strap 101. Both grasping members 109 and 111 are shown in FIG. 4 to have a mutually opposite angulated offset of about 5 to 30 degrees with respect to the main body portion 103; however, in extraction tests, which measure the force required to pull the heater bead strap 101 from the glass support rod, it has been determined that with only one of the grasping members angulated with respect to the main body portion 103 of the heater bead strap 101, the glass support rod usually fails before the grasping members of the heater bead strap 101 can be extracted from the support rod. Table I summarizes the results of tests performed on the improved heater bead strap 101.

TABLE I

| SAMPLE | PENETRATION FORCE kg | EXTRACTION FORCE kg |
|---|---|---|
| A | 1.54 | 15.0* |
| B | 1.36 | 14.2+ |

*four of five samples pulled glass
+one of five samples pulled glass

In the first series of tests indicated as Sample A, 5 heater bead straps of the improved design were embedded in multiform support rods identical in composition to the support rods 23*a* and 23*b* described herein. Only one of the grasping members 109 and 111 had an angulated offset of about 16 degrees with respect to the main body portion 103 of the heater bead strap 101. Sample B comprises 5 heater bead straps similar to those of sample A except that neither of the grasping members 109 and 111 was angulated with respect to the main body portion 103 of the strap 101. For each of the straps in samples A and B, the proximal end 107 of the bead strap 101 was embedded a distance of about 1.78 mm into a glass support bead identical in composition to the support rods 23*a* and 23*b*. Both the force required to achieve a penetration of 1.78 mm and the force required to extract the bead strap samples in a direction normal to the surface of the support rod were determined and the averages are indicated in Table I. Note that in sample A in four out of five instances, with one of the grasping members angulated about 16 degrees with respect to this body 103 of the strap 101, the grasping members 109 and 111 pulled or removed a portion of the glass support bead during the extraction test. In other words, the retention strength of the improved claw exceeded the strength of the support bead.

For comparison purposes, the penetration and extraction forces were measured on an electrode support structure similar in design to that shown in FIGS. 5 and 6 of U.S. Pat. No. 4,096,408 issued on June 20, 1978 to L. T. Bozzay, et al. The widely spaced pair of support tabs described in the Bozzay, et al. patent lacks the retention provided by the present novel angulated grasping members. In the Bozzay, et al. structure, it is disclosed that the support tabs are relatively narrow and are spaced apart a distance that is preferably equal to at least one-half the maximum width of the electrode. Three sets of samples included as sample C, D and E were prepared. Each set of samples included 10 parts. In sample C, each of the 10 parts had a support structure comprising two widely spaced tabs that were straight relative to the body of the electrode. Sample D comrised a support structure of the same configuration as that of sample C; however, the tabs were angulated about 16 degrees with respect to the body of the electrode. Sample E was similar to sample C except that the tabs were torsionally rotated or deflected about 30 degrees. The average penetration force and extraction force for each set of samples were measured and the average values are listed in TABLE II. In none of the samples was the retention of the tabs in the glass support bead great enough to cause the tabs to pull glass during the extraction test. As in the tests summarized in TABLE I, the samples C, D and E had a tab penetration distance of about 1.78 mm and the glass support beads were identical in composition to the support rods 23*a* and 23*b*.

TABLE II

| SAMPLE | PENETRATION FORCE kg | EXTRACTION FORCE kg |
|---|---|---|
| C | 0.36 | 6.9** |
| D | 0.36 | 5.9*** |
| E | 0.82 | 12.35 |

**two of ten straight tabs were loose in the glass support rod
*five of ten angled tabs were loose in the glass support rod A comparison of Tables I and II indicates that superior retention, as measured by extraction force, was achieved using the novel heater bead straps 101 with angulated grasping members 109 and 111. The poor retention of the widely spaced tabs of samples C, D and E can be explained by the inability of the widely spaced tabs to capture any glass in the area between the tabs. In effect, the tabs of samples C, D and E acted separately rather than as a securing system like the closely spaced grasping members 109 and 111 of the heater bead strap 101**.

While the invention is described in terms of a heater bead strap attached to only one of the support rods 23*a* or 23*b*, it should be clear to one skilled in the art that the angulated grasping structure may be utilized on other elements of the electron gun such as the cathode assembly support and the claws of the electrode members which are embedded in the support rods 23*a* and 23*b*. By way of illustration, FIG. 5 shows a cathode assembly 125 including a cathode support 161 embedded in the support rods 23*a* and 23*b* and having an angulated grasping member with an offset identical to that described herein for the heater bead strap 101.

What is claimed is:

1. In an electron gun assembly having means for generating and directing at least one electron beam along a beam path, said generating and directing means being spaced along a plurality of insulating support means, said generating and directing means including attachment means to facilitate securing said generating and directing means to said insulating support means, the improvement wherein said attachment means includes a main body portion having a distal end and a proximal end, said proximal end having a pair of closely spaced apart grasping members, each of said grasping members having an inner leading edge with a first radius, $r_1$, and an outer edge with a second radius, $r_2$, wherein $r_1 < r_2$, said inner leading edge forming an acute angle with respect to said outer edge, said edge radii and said acute angle providing means for reducing the viscous drag on said grasping members during embedment into said insulating support means, at least one member of said pair of grasping members forming an acute angle with respect to the other member of said pair of grasping members to increase the retention of said attachment means to said insulating support means.

2. In a multi-beam electron gun assembly for use in a cathode ray tube, said gun assembly including a plurality of indirectly heated cathode assemblies and at least two spaced successive electrodes having aligned apertures therein for passage of a plurality of electron beams, said cathode assemblies including a plurality of cathode heaters, said heaters being attached to at least two electrically insulating support rods by a plurality of heater bead straps, the improvement wherein each of said heater bead straps including a main body portion having a distal end and a proximal end, said proximal end having a bifurcated portion comprising a pair of closely spaced apart grasping member defining a cavity therebetween, each of said grasping members having an inner leading edge with a radius, $r_1$, and an outer edge with a radius, $r_2$, wherein $r_1 < r_2$, said inner leading edge forming an acute angle with respect to said outer edge, said edge radii and said acute angle providing means to reduce the viscous drag on said grasping members during embedment into one of the insulating support rods, at least one member of said pair of grasping members forming an acute angle with respect to said main body portion to increase the retention of said heater bead straps to said insulating support rods.

3. The electron gun assembly as in claim 2 wherein said one member makes an angle of about 12 to 16 degrees with respect to said main body portion of said heater bead strap.

4. The electron gun assembly as in claim 2 wherein both of said members of said pair of grasping members, are formed at an acute angle with respect to said main body portion of said heater bead strap.

5. The electron gun assembly as in claim 4 wherein said pair of grasping members are formed at an acute angle in mutually opposite directions with respect to one another, with each of said members making an angle of about 12 to 16 degrees with respect to said main body portion of said heater bead strap.

* * * * *